US008444403B2

(12) United States Patent
Tang

(10) Patent No.: US 8,444,403 B2
(45) Date of Patent: May 21, 2013

(54) SELF-SEALING MECHANISM FOR SCROLL COMPRESSOR

(75) Inventor: Yueh-Ju Tang, Hsinchu (TW)

(73) Assignee: Industrial Technology Research Institute, Hsin-Chu (TW)

( * ) Notice: Subject to any disclaimer, the term of this patent is extended or adjusted under 35 U.S.C. 154(b) by 495 days.

(21) Appl. No.: 12/796,318

(22) Filed: Jun. 8, 2010

(65) Prior Publication Data

US 2011/0135524 A1 Jun. 9, 2011

(30) Foreign Application Priority Data

Dec. 4, 2009 (TW) ..... 98141494 A

(51) Int. Cl.
*F03C 2/00* (2006.01)

(52) U.S. Cl.
USPC ..... 418/55.4; 418/55.1; 418/270; 418/55.2; 418/55.3; 418/57

(58) Field of Classification Search
USPC ..... 418/55.1–55.6, 57, 270
See application file for complete search history.

(56) References Cited

U.S. PATENT DOCUMENTS

| | | | | |
|---|---|---|---|---|
| 4,379,470 | A * | 4/1983 | Reutter | 137/493.8 |
| 4,744,733 | A * | 5/1988 | Terauchi et al. | 417/310 |
| 4,861,245 | A | 8/1989 | Tojo et al. | |
| 5,252,046 | A | 10/1993 | Wen-Ding et al. | |
| 5,503,542 | A * | 4/1996 | Grassbaugh et al. | 418/55.1 |
| 6,494,688 | B1 * | 12/2002 | Barito et al. | 417/310 |
| 7,491,045 | B2 * | 2/2009 | Masuda | 418/55.5 |
| 2007/0178002 | A1 * | 8/2007 | Hiwata et al. | 418/55.2 |
| 2007/0201997 | A1 * | 8/2007 | Hiwata et al. | 418/55.6 |
| 2007/0212244 | A1 * | 9/2007 | Futagami et al. | 418/55.2 |

FOREIGN PATENT DOCUMENTS

| | | | |
|---|---|---|---|
| CN | 1251639 | A | 4/2000 |
| CN | 200993100 | Y | 12/2007 |
| JP | 1300080 | A | 12/1989 |
| JP | 8082294 | A | 3/1996 |

(Continued)

OTHER PUBLICATIONS

State Intellectual Property Office of the People's Republic of China, "Office Action", Jul. 27, 2012, China.

(Continued)

*Primary Examiner* — Thomas Denion
*Assistant Examiner* — Thomas Olszewski
(74) *Attorney, Agent, or Firm* — Morris Manning & Martin LLP; Tim Tingkang Xia, Esq.

(57) ABSTRACT

A self-sealing mechanism for a scroll compressor is disposed inside a frame of the scroll compressor at a position between a back-pressure chamber and a fixed scroll, including an accommodating space; a groove communicating the space with the chamber; a one-way valve disposed at one end of the space adjacent to the groove to maintain communication between the space and the groove in a normally closed state; and a suction port penetrating from the space to an entrance of the fixed scroll. When the pressure of the chamber is increased in an instant, the valve is opened in real time for allowing the lubricating oil inside the chamber to flow into the space, thereby regulating the pressure of the chamber. Moreover, the lubricating oil in the space can be sucked under the suction force from the fixed scroll and fill in positions between the fixed scroll and an orbiting scroll.

6 Claims, 4 Drawing Sheets

FOREIGN PATENT DOCUMENTS

| | | | |
|---|---|---|---|
| JP | 9021390 | A | 1/1997 |
| JP | 2001304147 | A | 10/2001 |
| JP | 2001355584 | A | 12/2001 |
| TW | 235791 | B | 7/2005 |

OTHER PUBLICATIONS

Ishii et al., Lubrication Mechanism at Thrust Sline-Bearing of Scroll Compressors (Experimental Study), International Compressor Engineering Conference at Purdue, Jul. 12-15, 2004, C103, 8 pages.

Oku, Phd et al., Theoretical Model of Lubrication Mechanism in the Thrust Slide-Bearing of Scroll Compressors, HVAC&R Research, Mar. 2008, pp. 239-258, vol. 14, No. 2.

Oku et al., Lubrucation Mechanism at Thrust Sline-Bearing of Scroll Compressors (Theorectical Study), International Compressor Engineering Conference at Purdue, Jul. 12-15, 2004, C104, 8 pages.

Okaichi et al., A Study on Lubrication Characteristics of Journal and Thrust Bearings in Scroll Compressors, International Compressor Engineering Conference at Purdue, Jul. 12-15, 2004, C116, 8 pages.

* cited by examiner

SELF-SEALING MECHANISM FOR SCROLL COMPRESSOR

BACKGROUND

1. Technical Field

The present disclosure relates to the technical field of a scroll compressor, and more particularly to a self-sealing mechanism for assisting axial sealing of an orbiting scroll through dynamic oil pressure.

2. Related Art

The working principle of a scroll compressor is that: a motor rotor rotates and drives an eccentric shaft at an output end of a main shaft, so as to drive an orbiting scroll, and restricted by a rotation prevention member. The orbiting scroll performs an engaging movement of revolution rather than rotation relative to a fixed scroll, and performs volume-changing operations such as suction, compression, and discharge on a working fluid (for example, a refrigerant) in the above movement manner.

If the scroll compressor is expected to maintain a high working efficiency, a desirable sealing condition must be maintained between the fixed scroll and the orbiting scroll. Leakage during the operation of the scroll compressor is mainly caused by changes of the clearance between the orbiting scroll and the fixed scroll.

For a scroll compressor using HFC refrigerant, the clearance between a top end of an orbiting scroll blade and a bottom plate of the fixed scroll needs to be maintained at 3 to 10 μm, so as to allow a sealing film formed by a lubricating oil film to maintain a sealing effect. In contrast, for a scroll compressor using environmental in noxious refrigerant—$CO_2$, since the $CO_2$ refrigerant has a surface cleaning feature, and the operating pressure of the $CO_2$ refrigerant compressor is about 3 to 4 times as much as that of the HFC refrigerant, the lubricating oil must be continuously fed to positions between the orbiting scroll and the fixed scroll, so that the lubricating effect is maintained even when the clearance between the orbiting scroll and the fixed scroll is below 3 μm, thereby avoiding the abrasion.

Moreover, no matter which type of refrigerant is used by the compressor, due to the mutual solubility of the lubricating oil and the refrigerant, extra lubricating oil must be fed periodically, so as to ensure the constant amount of the lubricating oil in the compressor.

A common axial sealing mechanism for the scroll compressor is to provide an axial pressure during the operation of the scroll compressor, so as to achieve the axial sealing effect between the orbiting scroll and the fixed scroll. For example, the lubricating oil is supplied using an oil pump, and is filled into a back-pressure chamber formed between a back side of the orbiting scroll and the frame. Since the compressor body is filled up with a high-pressure refrigerant therein, the pressure of the high-pressure refrigerant is transmitted into the back-pressure chamber, so that an axial pushing force against the orbiting scroll is formed and pushing the orbiting scroll towards the fixed scroll, so as to eliminate the axial clearance there-between, thereby achieving a desirable sealing effect.

The axial sealing force cannot be generated unless the pressure of the back-pressure chamber is greater than a scroll separating force generated during compression of the working fluid, and the sealing force cannot be too large, so as to avoid excessively pushing the orbiting scroll towards the fixed scroll and cause the top portion of the orbiting scroll blade to contact with the bottom plate of the fixed scroll, resulting in unnecessary axial friction loss. On the contrary, if the axial sealing force is too small, the orbiting scroll may be capsized, thereby causing separation of the scrolls and thus resulting in leakage.

SUMMARY

Accordingly, the present disclosure is mainly directed to a self-sealing mechanism for a scroll compressor, which is capable of providing a quick response to a pressure of a back-pressure chamber and regulating the pressure of the back-pressure chamber in real time.

In order to achieve the above objective, the self-sealing mechanism of the present disclosure is disposed inside a frame of the scroll compressor at a position between a back-pressure chamber and a fixed scroll, and includes a groove, an accommodating space, a one-way valve, and a suction port. The groove is in communication with the back-pressure chamber. The accommodating space is in communication with the groove. The one-way valve is disposed at one end of the accommodating space adjacent to the groove, so as to enable the communication between the accommodating space and the groove to be maintained in a normally closed state. The suction port is formed penetrating from the accommodating space to an entrance of the fixed scroll.

Operationally, when the pressure of the back-pressure chamber of the scroll compressor is increased in an instant and exceeds a pressure preset by the one-way valve, the one-way valve is opened in real time for allowing a lubricating oil to flow into the accommodating space where it is stored, thereby enabling the pressure of the back-pressure chamber to be regulated, and preventing the axial friction between the orbiting scroll and the fixed scroll from being increased due to an excessively large back pressure of the back-pressure chamber. Moreover, the lubricating oil stored in the accommodating space can be sucked through the suction port as a suction force is changed at the entrance of the fixed scroll, and thus fill in positions between the fixed scroll and an orbiting scroll to further feed the lubricating oil for lubrication.

Thus, the present disclosure can automatically assist axial sealing of the orbiting scroll by using dynamic oil pressure.

In an embodiment, the groove is recessed into a surface of the frame in contact with the fixed scroll. The accommodating space is disposed at a position of the fixed scroll and above the groove. The suction port extends slantwise downward from one end of the accommodating space far away from the groove to the entrance of the fixed scroll, so as to enable the accommodating space to have a large volume for storing the lubricating oil.

In an embodiment, the one-way valve is formed by a flat valve flake in combination with a spring, so as to achieve normally closed and one-way opening functions.

In another embodiment, the one-way valve is configured into a ball valve structure and has a valve seat. The valve seat is disposed at the end of the accommodating space adjacent to the groove, and the valve seat includes a ball body disposed therein. The ball body is pressed by a spring, so as to close the valve seat. For example, a spring retainer is disposed at one end of the spring opposite to the ball body to fix the spring, and enables the spring to apply a pre-pressure on the ball body, so as to achieve the normally closed and one-way opening functions.

In order to make the aforementioned features and characteristics of the present disclosure more comprehensible, embodiments accompanied with figures are described in detail below.

DETAILED DESCRIPTION

Figure 1:
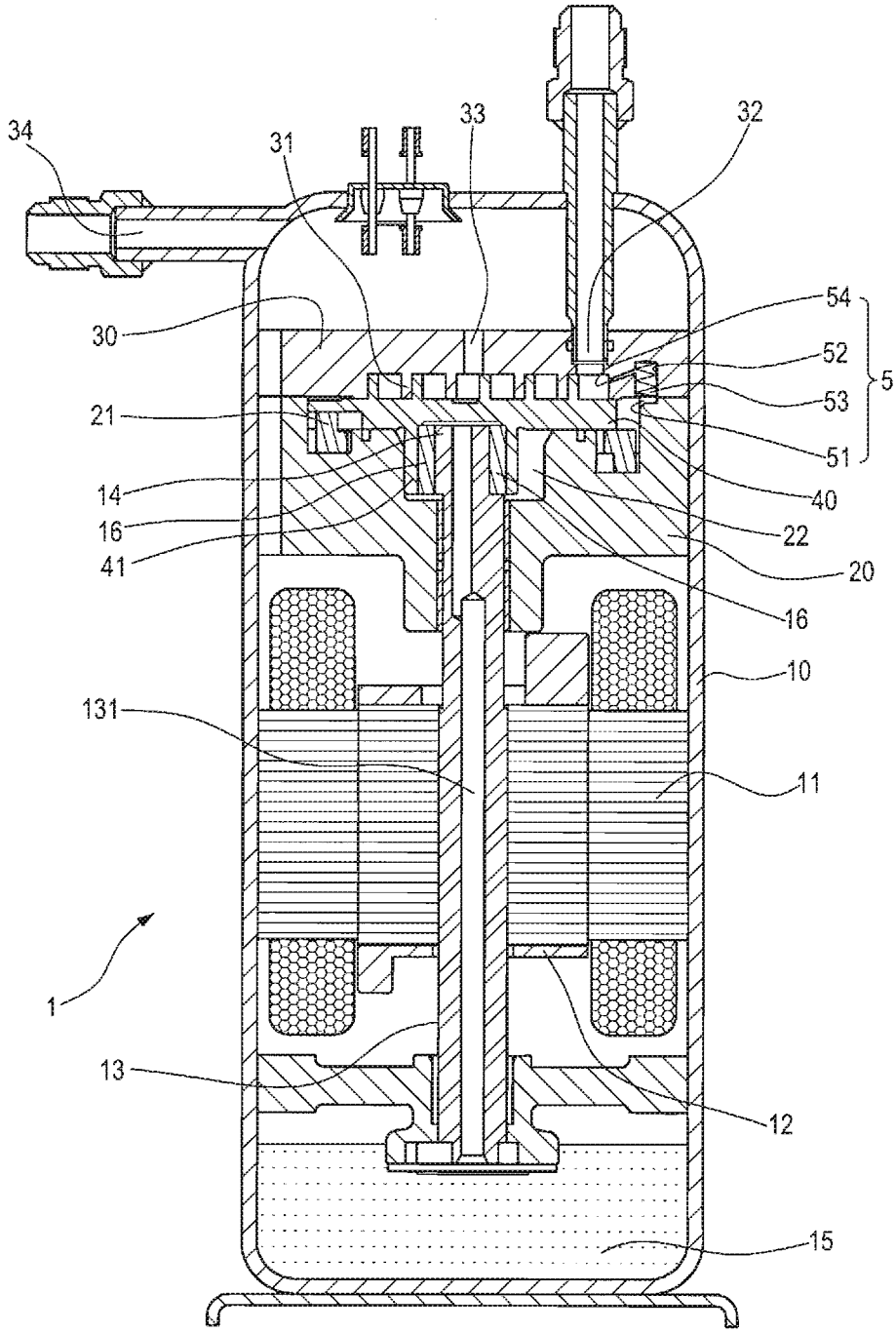
FIG. 1 is a schematic cross-sectional structural view of the present disclosure applied in a scroll compressor.

In the following detailed description, for purpose of explanation, numerous specific details are set forth in order to provide a through understanding of the disclosed embodiments. It will be apparent, however, that one or more embodiments may be practiced without these specific details. In other instances, well-known structures and devices are schematically shown in order to simplify the drawing.

Figure 2:
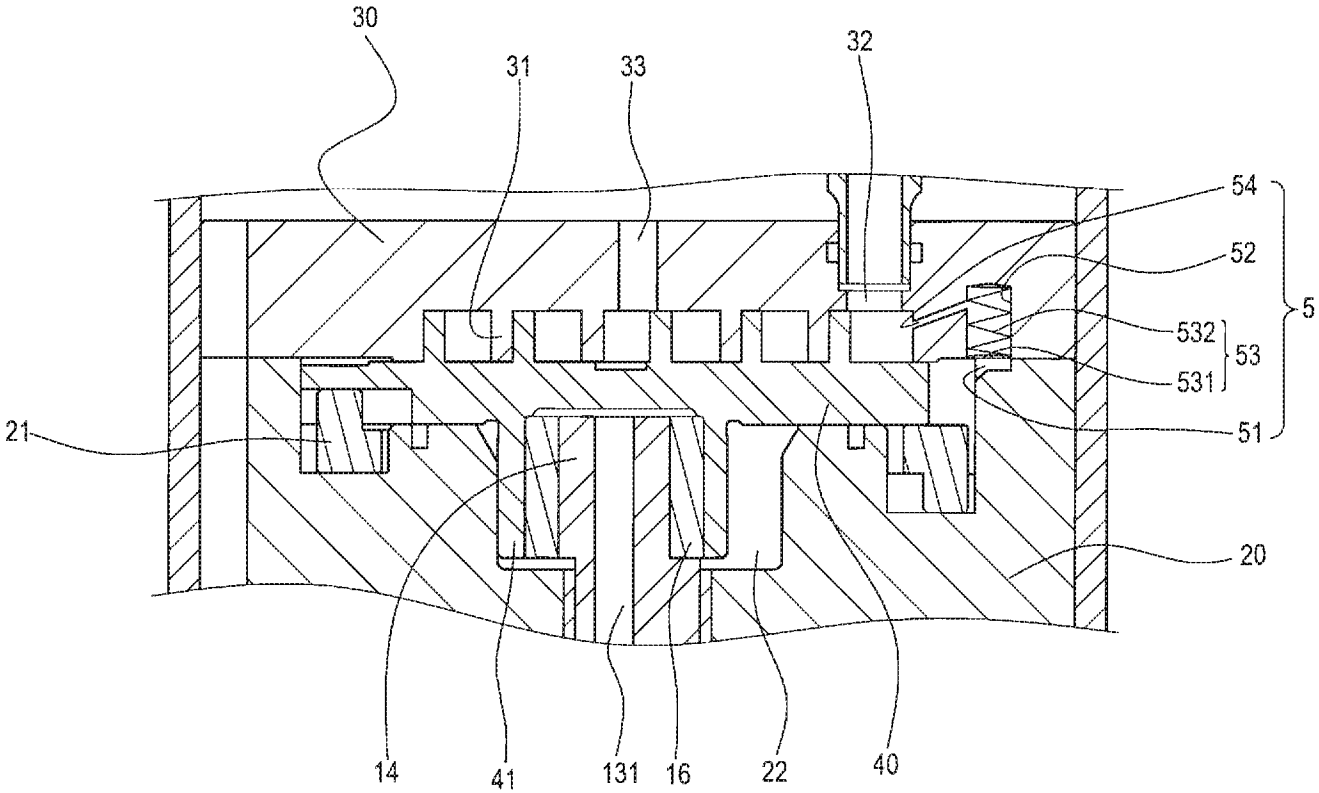
FIG. 2 is a schematic cross-sectional structural view of the present disclosure.

FIG. 1 is a schematic cross-sectional structural view of the present disclosure applied in a scroll compressor; FIG. 2 is a schematic cross-sectional structural view of the present disclosure; and FIG. 3 is a schematic view illustrating a using state of the present disclosure.

Figure 3:
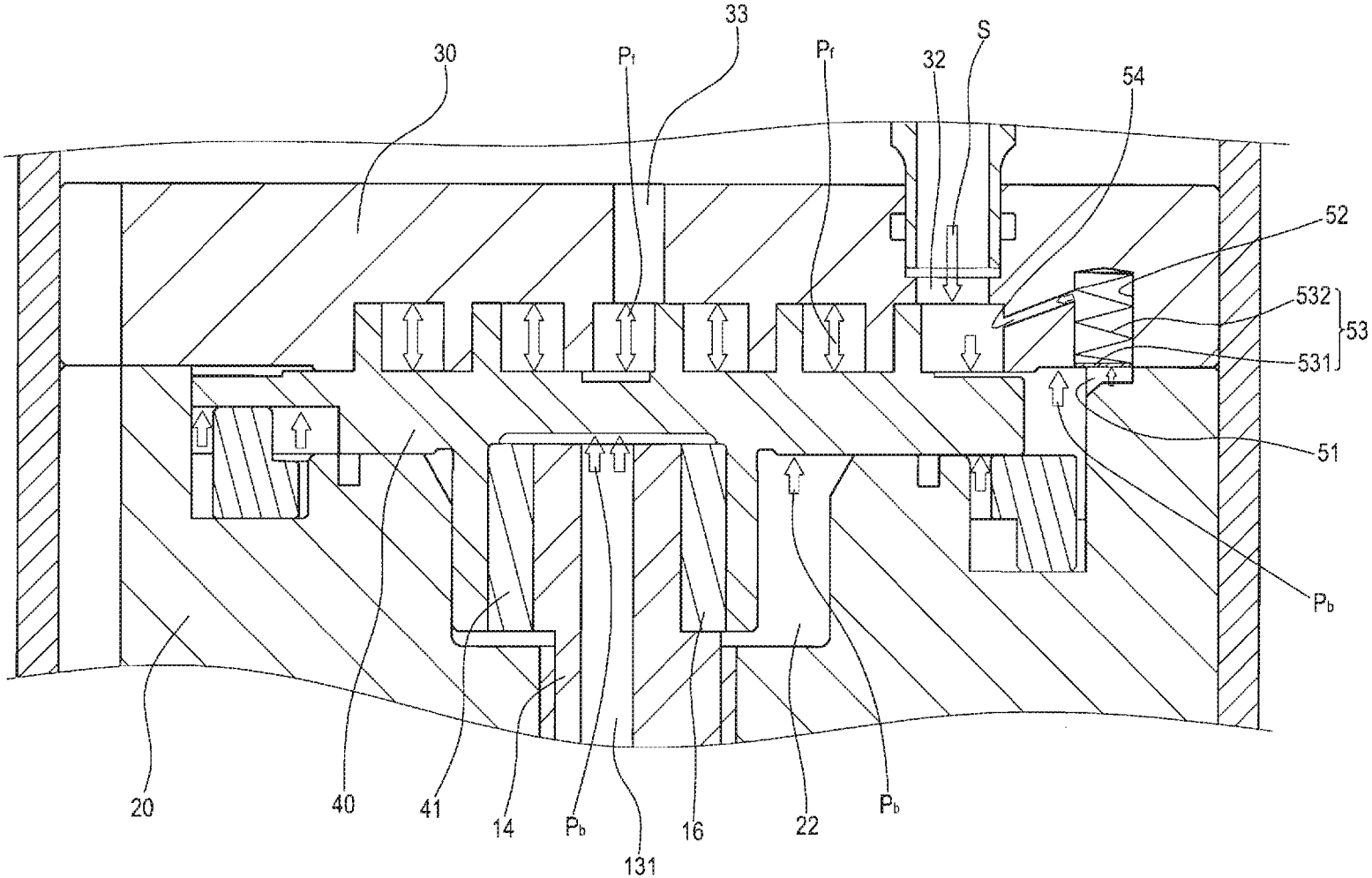
FIG. 3 is a schematic view illustrating a using state of the present disclosure.

Referring to FIGS. 1 to 3, in the structure of a scroll compressor 1, a motor stator 11 and a motor rotor 12 are disposed in a housing 10, and the motor rotor 12 is combined with a main shaft 13. One end (top end) of the main shaft 13 has an eccentric shaft 14, and the end of the main shaft 13 having the eccentric shaft 14 is inserted into a frame 20 disposed at an upper section of the housing 10. The other end (bottom end) of the main shaft 13 extends into an oil tank 15 at the bottom of the housing 10, and if necessary, an oil pump (not shown) may be disposed at the end. Moreover, the main shaft 13 has a passage 131 therein, and the passage 131 penetrates the main shaft 13, so as to enable the lubricating oil in the oil tank 15 to be transported to one end of the eccentric shaft 14 through the passage 131.

The frame 20 is provided for disposing a fixed scroll 30 and an orbiting scroll 40 therein. The fixed scroll 30 and the frame 20 are fixed and combined by a fixing element. The orbiting scroll 40 may be rotatably disposed between the frame 20 and the fixed scroll 30. Restricted by a rotation prevention member 21, the orbiting scroll 40 performs an engaging movement of revolution rather than rotation relative to the fixed scroll 30.

The orbiting scroll 40 has a base 41 corresponding to the eccentric shaft 14, and the eccentric shaft 14 is connected to the base 41 through a bearing member 16. When the main shaft 13 rotates, the eccentric shaft 14 drives the orbiting scroll 40 to revolve rather than rotate relative to the fixed scroll 30.

The frame 20 has a back-pressure chamber 22 recessed therein corresponding to the orbiting scroll 40, and the back-pressure chamber 22 is in communication with the passage 131 of the main shaft 13, so as to enable the lubricating oil in the oil tank 15 to be transported to the back-pressure chamber 22 through the passage 131 and thus fill up the back-pressure chamber 22.

The fixed scroll 30 has an entrance 32 connected to a peripheral portion of a scroll blade 31, and the fixed scroll 30 has a discharge outlet 33 in the center thereof. The outlet 33 penetrates a central portion of the fixed scroll 30, so that the working fluid entering through the entrance 32 is gradually compressed by the orbiting scroll 40 from the peripheral portion of the scroll blade 31 towards the central portion, and flows into the housing 10 through the outlet 33 and thus fills up the housing 10, and is finally discharged through a discharge pipe 34.

The self-sealing mechanism of the present disclosure is an oil amount control mechanism 5. The oil amount control mechanism 5 has a groove 51. The groove 51 is in communication with the back-pressure chamber 22. The oil amount control mechanism 5 has an accommodating space 52 corresponding to the groove 51. A one-way valve 53 is disposed at one end of the accommodating space 52 adjacent to the groove 51. The accommodating space 52 has a suction port 54. The suction port 54 is in communication with the accommodating space 52 and portion where the scroll blade 31 and the entrance 32 of the fixed scroll 30 are connected.

In this embodiment, the groove 51 is located on a surface of the frame 20 in contact with the fixed scroll 30. The accommodating space 52 is disposed at a position of the fixed scroll 30. The one-way valve 53 is formed by a flat valve flake 531 in combination with a spring 532, so as to enable the one-way valve 53 to be in a normally closed state. The suction port 54 extends slantwise downward from one end of the accommodating space 52 far away from the groove 51 to a portion where the scroll blade 31 and the entrance 32 of the fixed scroll 30 are connected.

Referring to FIGS. 1 and 3, when the main shaft 13 rotates and drives the orbiting scroll 40 to rotate, a low pressure working fluid flows through the entrance 32 into positions between the fixed scroll 30 and the orbiting scroll 40, and as the rotation angle of the orbiting scroll 40 changes, the low pressure working fluid is gradually squeezed from the peripheral portion towards the central portion, so that the volume thereof is gradually compressed and the pressure thereof is gradually increased, so as to generate a pushing force $P_f$ to push the orbiting scroll 40 away from the fixed scroll 30. After the working fluid is squeezed to a central portion of the fixed scroll 30, the working fluid is in a high pressure state, and discharged through the outlet 33.

Operationally, the lubricating oil in the oil tank 15 at the bottom of the housing 10 is continuously transported to the back-pressure chamber 22 through the passage 131 under the joint effect of the high pressure working fluid and the oil pump, so as to generate an axial pushing force to push the orbiting scroll 40 towards the fixed scroll 30. Such a pressure is just a back pressure $P_b$. Once the lubricating oil is transported to the back-pressure chamber 22, the lubrication required between the orbiting scroll 40 and the frame 20 can be provided.

Definitely, as the rotation rate of the orbiting scroll 40 varies, different amounts of the lubricating oil may be continuously transported from the oil tank 15 to the back-pressure chamber 22 through the passage 131. When the rotation rate of the orbiting scroll 40 is increased, the amount of the supplied lubricating oil is increased to enable the back pressure $P_b$ of the back-pressure chamber 22 to be correspondingly increased, so as to resist the pushing force $P_f$ of the orbiting scroll 40 during the high-speed operation and provide lubrication required by the orbiting scroll 40 during the high-speed operation.

The groove 51 of the oil amount control mechanism 5 is in communication with the back-pressure chamber 22. When the back pressure $P_b$ of the back-pressure chamber 22 exceeds a pressure threshold preset by the one-way valve 53, the lubricating oil pushes aside the flat valve flake 531 and flows into the accommodating space 52 where it is stored, rather than being directly transported to the entrance 32.

When the orbiting scroll 40 operates, a suction force S is generated at the entrance 32, so as to continuously suck the low pressure working fluid to the interior through the entrance 32. Since the suction port 54 of the oil amount control mechanism 5 is in communication with the entrance 32, the suction force S enables the lubricating oil stored in the accommodating space 52 to be sucked to the interior through the suction port 54, so as to continuously supply the lubricating oil required between a top surface of the orbiting scroll 40 and the fixed scroll 30.

In the oil amount control mechanism 5 of the present disclosure, the one-way valve 53 is used to control whether to communicate the groove 51 with the accommodating space 52. Thus, when the pressure of the back-pressure chamber 22 is increased in an instant, the one-way valve 53 is opened in real time for allowing the lubricating oil to flow into the accommodating space 52 where it is stored. Therefore, the present disclosure is capable of providing a quick response to the pressure of the back-pressure chamber 22 and regulating the pressure of the back-pressure chamber 22 in real time, so as to prevent the axial friction between the orbiting scroll 40 and the fixed scroll 30 from being increased due to an excessively large back pressure $P_b$ of the back-pressure chamber 22 caused by the storage of a large amount of lubricating oil in the back-pressure chamber 22 in a unit time. In addition, the lubricating oil stored in the accommodating space 52 may be sucked through the suction port 54 into positions between the orbiting scroll 40 and the fixed scroll 30 as the suction force S at the entrance 32 is changed, so that the lubricating oil required between the top surface of the orbiting scroll 40 and the fixed scroll 30 for lubrication during operation is continuously supplied.

Thus, the present disclosure can assist axial sealing of the orbiting scroll by using dynamic oil pressure.

Figure 4:
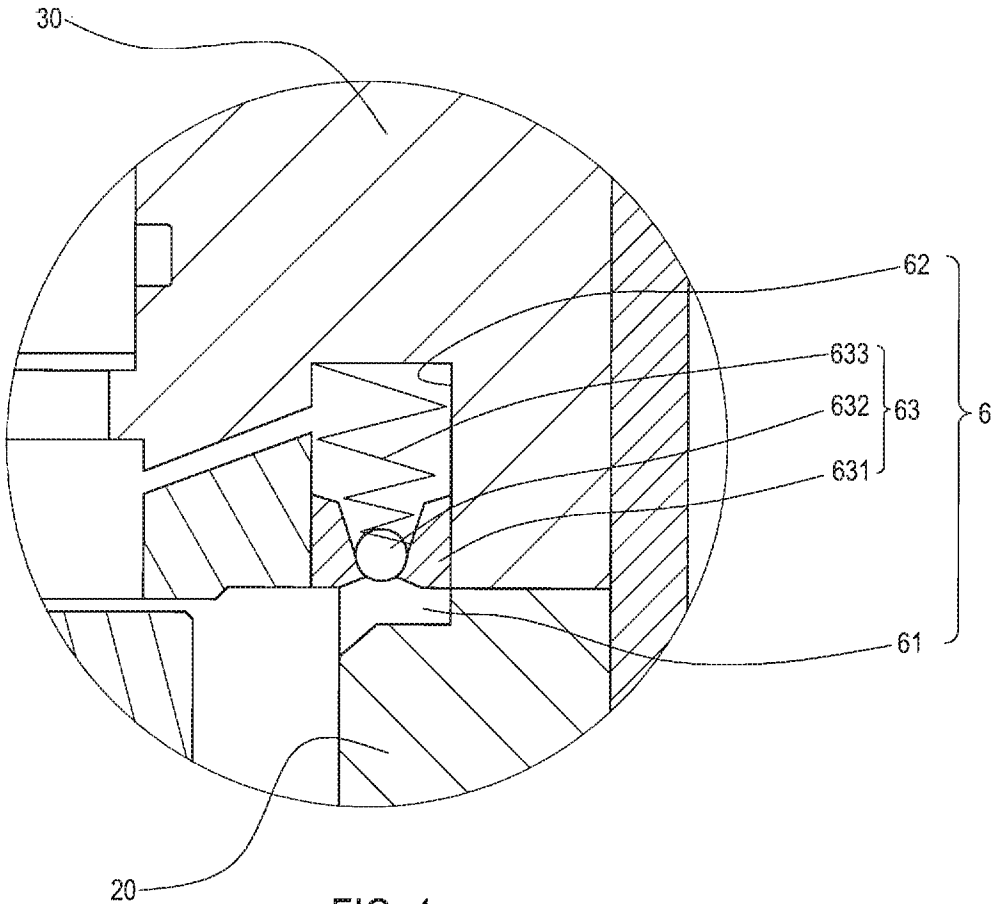
FIG. 4 is a schematic cross-sectional structural view of a second embodiment of the present disclosure.

FIG. 4 is a schematic cross-sectional structural view of a second embodiment of the present disclosure. Referring to FIG. 4, a one-way valve 63 of an oil amount control mechanism 6 is configured into a ball valve structure, and has a valve seat 631 disposed at an end of an accommodating space 62 adjacent to a groove 61. The valve seat 631 includes a ball body 632 disposed therein, and the ball body 632 is pressed by a spring 633, for example, a spring retainer is disposed at one end of the spring 633 opposite to the ball body 632 to fix the spring 633, and enables the spring 633 to apply a pre-pressure on the ball body 632, so as to close the valve seat 631. The one-way valve 63 in a ball valve structure may be used to replace the one-way valve in the first embodiment, and can achieve the same effect as the first embodiment.

The disclosure being thus described, it will be obvious that the same may be varied in many ways. Such variations are not to be regarded as a departure from the spirit and scope of the disclosure, and all such modifications as would be obvious to one skilled in the art are intended to be included within the scope of the following claims.

What is claimed is:

1. A self-sealing mechanism for a scroll compressor, disposed inside a frame of the scroll compressor at a position between a back-pressure chamber and a fixed scroll, the self-sealing mechanism comprising:

a groove, in communication with the back-pressure chamber;

an accommodating space, in communication with the groove;

a one-way valve, disposed at a first end of the accommodating space adjacent to the groove, so as to enable communication between the accommodating space and the groove to be maintained in a normally closed state; and a suction port, formed penetrating from the accommodating space to an entrance of the fixed scroll, wherein the accommodating space stores a lubricating oil transported from the back-pressure chamber through the one-way valve when a pressure of the back-pressure chamber is higher than a preset pressure threshold of the one-way valve; and wherein the suction port extends slantwise downward from a second end, opposite to the first end of the accommodating space and far away from the groove, to the entrance of the fixed scroll, such that a continuous supply of the lubricating oil from the accommodating space is provided by a suction force generated at the entrance of the fixed scroll.

2. The self-sealing mechanism for a scroll compressor according to claim 1, wherein the groove is recessed into a surface of the frame in contact with the fixed scroll.

3. The self-sealing mechanism for a scroll compressor according to claim 1, wherein the accommodating space is disposed at a position of the fixed scroll and is located above the groove.

4. The self-sealing mechanism for a scroll compressor according to claim 1, wherein the one-way valve is formed by a flat valve flake in combination with a spring.

5. The self-sealing mechanism for a scroll compressor according to claim 1, wherein the one-way valve is configured into a ball valve structure.

6. The self-sealing mechanism for a scroll compressor according to claim 5, wherein the one-way valve has a valve seat, the valve seat is disposed at the end of the accommodating space adjacent to the groove, the valve seat comprises a ball body disposed therein, and the ball body is pressed by a spring, so as to close the valve seat.

* * * * *